US005836234A

United States Patent [19]

Chen et al.

[11] Patent Number: 5,836,234

[45] Date of Patent: Nov. 17, 1998

[54] SINGLE CAM RECIPROCATING LINKED PISTON TYPE ENGINE

[76] Inventors: Feichang Chen; Zhigeng Xi, both of Guagao Road, Guangmang Bridge, Pudong, Shanghai 201208, P.R.; Lei Chen, Shanghai Jiao Tong University, Shanghai 200030, P.R., all of Canada

[21] Appl. No.: 676,175

[22] PCT Filed: Jan. 1, 1994

[86] PCT No.: PCT/CN94/00003

§ 371 Date: Feb. 13, 1997

§ 102(e) Date: Feb. 13, 1997

[87] PCT Pub. No.: WO95/18915

PCT Pub. Date: Jul. 13, 1995

[51] Int. Cl.[6] ..... F01B 1/00

[52] U.S. Cl. ..... 92/72; 92/138; 92/141; 123/54.2; 123/54.3; 123/54.5

[58] Field of Search ..... 92/72, 138, 141; 123/54.2, 54.3, 54.5, 54.6, 54.7, 54.8

[56] References Cited

U.S. PATENT DOCUMENTS

| | | | |
|---|---|---|---|
| 1,630,273 | 5/1927 | Nordwick | 123/54.3 |
| 1,765,237 | 6/1930 | King | 123/54.2 |
| 1,765,713 | 6/1930 | Boland . | |
| 1,830,046 | 11/1931 | White | 123/54.2 |
| 1,904,680 | 4/1933 | Ferry | 123/54.3 |

FOREIGN PATENT DOCUMENTS

| | | | |
|---|---|---|---|
| 1043769 | 11/1990 | China . | |
| 1015017 | 4/1991 | China . | |
| 2160762 | 6/1994 | China . | |
| 0 177 214 | 4/1986 | European Pat. Off. . | |
| 476799 | 8/1915 | France | 123/54.3 |
| 652657 | 3/1929 | France | 123/54.3 |

OTHER PUBLICATIONS

*China Science and Technology Daily*, Feb. 8, 1992 re Benz 169 HP engine.

*Primary Examiner*—Thomas E. Denion

*Attorney, Agent, or Firm*—Merchant, Gould, Smith, Edell, Welter & Schmidt

[57] ABSTRACT

A single cam reciprocating linked piston type engine utilizes a swing-link linking mechanism to make two pistons arranged at an included angle slide alternately up and down, or utilizes a linking-rod to make two pistons arranged on an identical axis reciprocate in the same direction. Each roller mounted in the piston skirt nestles tightly on the curved surface of a cam mounted on a main shaft, so as to transform reciprocating motion of the pistons into rotation of the main shaft. The engine has eliminated an inner cam and the complicated piston mechanism as compared with a conventional double cam internal combustion engine. It features a simple and compact structure, its output torque is able to be raised twice as much, and a speed reducer matched with the engine is simple in structure. It can replace double cam engines and conventional crankshaft and connecting-rod type engines and is applicable for use as a motor in various fields.

6 Claims, 7 Drawing Sheets

FIG.3
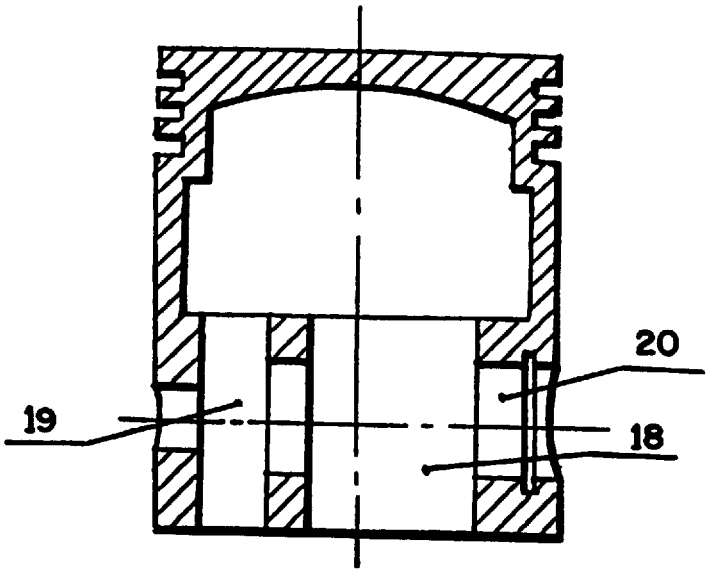
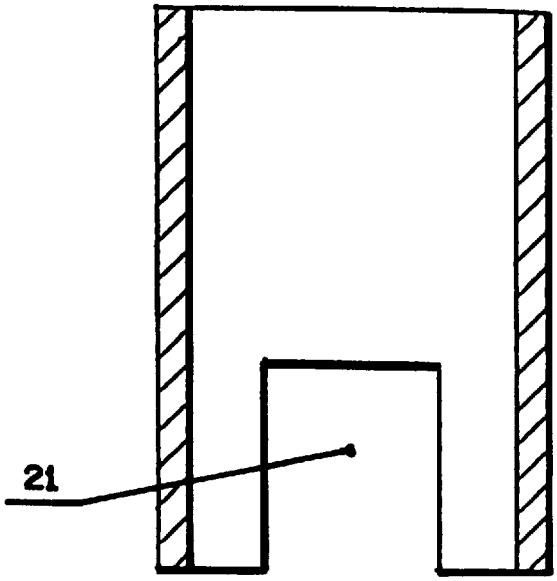
FIG.4
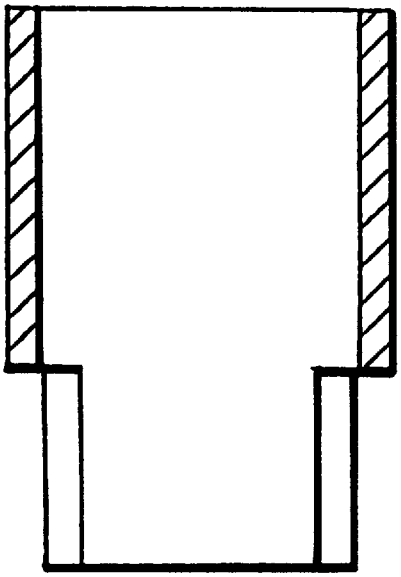
FIG.5

SINGLE CAM RECIPROCATING LINKED PISTON TYPE ENGINE

FIELD OF THE INVENTION

The present invention relates to a cam piston type engine.

BACKGROUND OF THE INVENTION

Conventional reciprocating piston type engines adopt a crankshaft and connecting-rod mechanism. In order to overcome the improper kinematics of such a mechanism, William Martin Waide of BCDS Corporation (European Patent Application 0,177,214) invented in 1984 a compact, double cam internal combustion engine. In 1991, the Benz Co. of Germany successfully assembled this engine on its sedans. This engine has retained the advantage of good leak tightness found in reciprocating cylindrical pistons, eliminated the crank shaft and connecting rod mechanism and made the engine more compact. However, it used two inner and outer cams, and two sets of roller pair subassemblies to replace the crankshaft and connecting-rod mechanism. Furthermore, because of this structure, the pistons cannot be made into the conventional skirt configuration and thus two sets of guides had to be added to each, piston, resulting in a more complicated structure. In 1989, a reciprocating linked piston type engine was invented which used only one outer cam and the pistons could be made into the conventional skirt configuration, so as to make the engine simpler as a whole. However, owing to the fact that two pistons of each set of linking mechanisms reciprocate simultaneously and no driving force occurs when the engine has not been started, it is necessary to add a device for starting the engine. Moreover, when the two pistons are linked in motion, there will be one stroke in which one piston is in a position to begin exhaust and the other piston is in a position to begin compression, and one piston moves outward away from the center. Since there is no restraining force towards the center at this moment, the roller attached to the piston will separate from the curved surface of the cam to produce impact phenomenon which will become more severe during high speed motion. In order to overcome this drawback, the measure of delaying discharging is uneconomical and unreasonable and only the measure of supercharging can be adopted. However, supercharging is inapplicable when designing engines with lower capacity.

SUMMARY OF THE INVENTION

The object of the present invention is to provide a single cam reciprocating linked piston type engine which is smaller in volume (over one fourth smaller than the conventional crankshaft and connecting-rod type engine having the same capacity), of low weight, high efficiency, large torque, good braking performance, low output rotational speed, and in which a single cam and a linking mechanism with swing-link linking mechanism or linking-rod are used to replace the complicated inner cam and piston mechanism of the conventional "double cam engine", and which is also superior to the conventional "reciprocating linked piston type engine".

The engine of the present invention comprises a swing-link linking mechanism or linking-rod, a cam mounted on a main shaft and a roller pair subassembly mounted at the lower end of a piston skirt.

The swing-link linking mechanism is composed of a swing-link, two pistons, two connecting rods, two roller pins and two swing-link pins. The swing-link swings around a certain point in a plane coincident with the main shaft axis and the bisector of an angle formed by the axes of the two cylinders in which the two pistons move. At two ends of the swing-link there are two swing-link pin holes symmetric about the swing-link pivot. The included angle of the center lines of the two cylinders is equal to the included angle formed by the lines joining the apex and the lowest point of the cam with the cam center, and the axes of the two cylinders intersect at the cam axis. Both ends of the two connecting rods are provided with connecting-rod pin holes respectively having parallel axes and equal distance from the shaft. One connecting-rod pin hole is connected to the roller pin hole by a roller pin, and the other is connected to the swing-link pin hole by a swing-link pin. When the swing-link is swinging, the two pistons produce an up and down linked motion, with one piston at the highest point position while the other piston is at the lowest point position. The peripheral curved surface of the cam is machined into a smooth curved surface defining a bisection or two-lobed shape, or defining a three-lobed shape having a plurality of equal sections without mutation points. When the cam rotates around the main shaft, its curved surface is also the moving locus of the two rollers comprising the roller pair subassembly which remain in constant tangency with the cam when each one follows its respective piston in up and down motion.

The linking-rod is a linear type connector with one linking-rod pin hole at its two respective ends to join with the two pistons by roller pins. There are two types of linking-rods. One is in a cylindrical form in which the linking-rod intersects with the axis of the main shaft and is not in interference with the main shaft by providing a spindle nose on the cylinder head; the other adopts a frame structure to diverge from the main shaft. The cam operating together with the linking-rod structure has a curved surface equally divided into an odd number of sections or lobes and without mutation points and is also the moving locus of the rollers mounted on the two pistons in constant tangency with the cam when the pistons are in linked motion (pair motion). Due to the application of digital control techniques in machine work or machining, the cam can be machined so as to have an optimal contour. The roller pair subassembly is composed of rollers, rolling needles and roller pins. The rollers and needles are fitted in the rectangular opening of the piston skirt, and connected with the piston roller pin hole by the roller pin. The circumferential surface of the rollers is tightly nestled against the cam surface to form linear contact with rolling friction therebetween. When the cam rotates, its curved surface pushes the rollers and makes one of the pistons move upward away from the center and makes the other piston move downward towards the center through the action of the swing-link mechanism or linking-rod; or when the pistons move to do work, they drive the cam to cause rotational motion. Therefore it can be used for a hydraulic motor or a compressor having the same structural configuration. When made into a hydraulic motor, the hydraulic oil is discharged without application of back pressure and thus the efficiency thereof is raised.

The engine of the present invention can have two or more cams mounted on the same main shaft in offset or staggered positions, and cylinders arranged into a multi-row circumferential structure to make the engine run more smoothly.

In the engine of the present invention, when the cam is machined into a bisection or two-lobed shape, or into a three-lobed shape having six equal sections forming the curved surface, the swing-link swings around its axis, four swing-link pin holes are provided on the swing-link and four pistons connected by four connecting-rods to the swing-link are arranged in a vertical direction to actuate the four pistons in linked motion. One swing-link is mounted on each side of the cam, and eight pistons are thus made to do work on it. By this structure, one swing-link can make four pistons produce linked motion, therefore in each stroke, there is one of the pistons to do work on the cam, and thus there is always one roller on the piston to nestle tightly against the curved surface of the cam. Therefore, if there are four rollers kept in tangency when at the apex and the lowest point on the curved surface of the cam, no impact and vibration will occur. When the cam of the present invention is machined into bisection or any number of equal sections in its curved surface, three swing-link pin holes are provided on one swing-link to make three pistons produce linked motion, and the swinging pivot of the swing-link will coincide with axis of the main shaft.

BRIEF DESCRIPTION OF THE DRAWINGS

The present invention will now be described in detail with reference to the accompanying drawings in which:

FIG. 3 is a sectional view showing the skirt structure of a piston.

FIG. 4 is a front view of a cylinder sleeve.

FIG. 5 is a left sectional view of the cylinder sleeve.

DESCRIPTION OF THE PREFERRED EMBODIMENT OF THE PRESENT INVENTION

Figure 1:
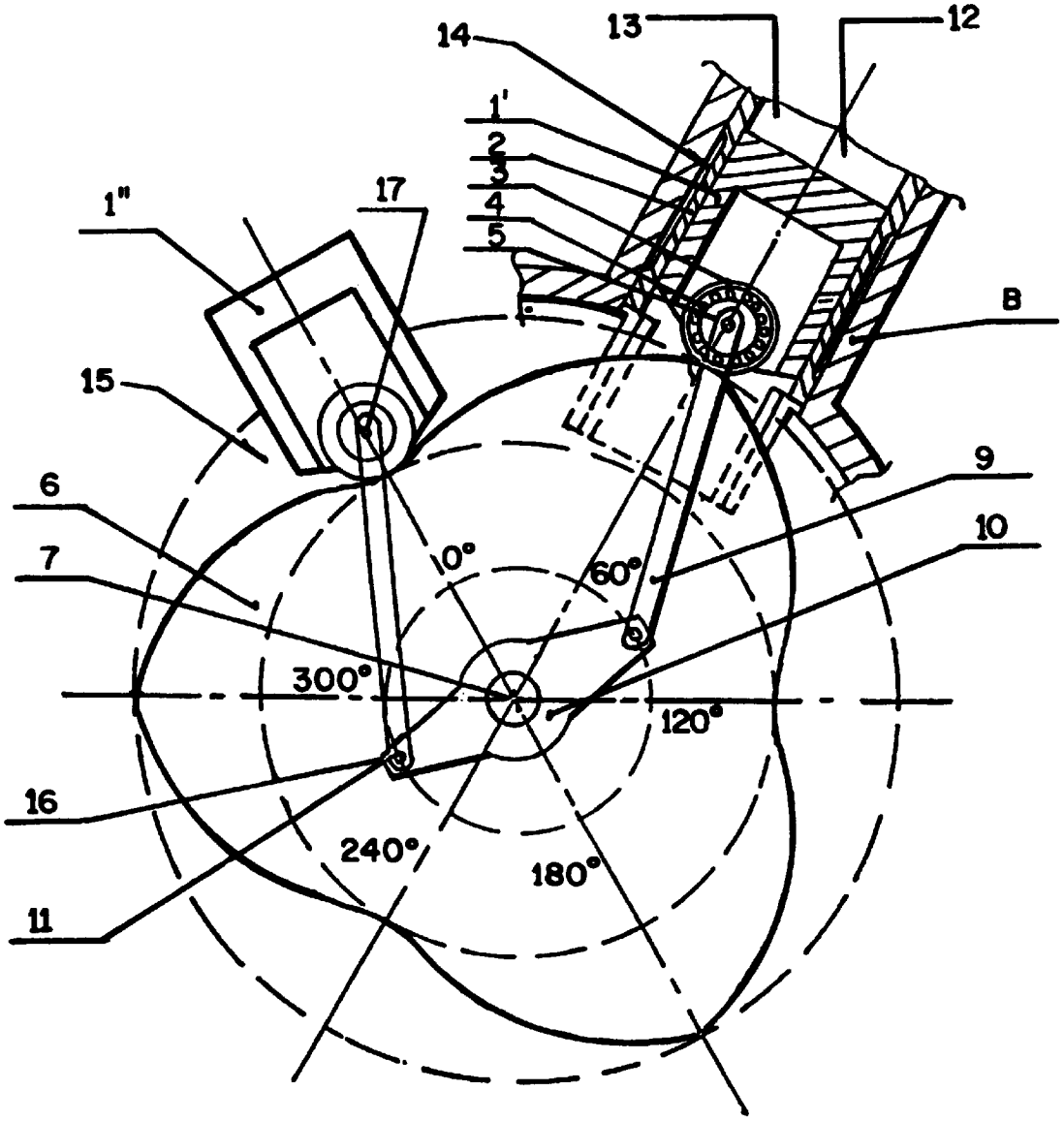
FIG. 1 is a schematic diagram of an engine, in which the cylinders are arranged at 60° intervals and employing a trisection cam and a swing-link linking mechanism.

According to FIG. 1, the engine of the invention comprises a fuel feed system 12, an intake and exhaust system 13, a lubricating system 15, and a cooling system 14 which are the same as in a conventional reciprocating engine. The engine further includes a cylinder block 8, specially constructed cylinder sleeves 2 (described with regards to FIGS. 4 and 5) and pistons 1', 1" reciprocating therein. At the end of the piston skirt are provided the rectangular openings 18 and 19 and roller pin holes 20, as shown in FIG. 3, and a roller pair subassembly composed of rollers 3 and needles 4 fitted in the rectangular opening 18, and roller pins 5 fitted in the roller pin holes 20. A cam 6 is fixedly connected to a main shaft 7. One swing-link 10, two connecting rods 9, two roller pins 5, two pistons 1', 1", and two swing-link pins 11 compose the swing-link linking mechanism. The two ends of each of the connecting rods are provided with connecting rod pin holes 17, one end thereof is fitted in the piston rectangular opening 19 by joining with the roller pin 5 fitted in the roller pin hole 20 of the piston, and the other end is joined by the swing-link pin 11 fitted in a swing-link pin hole 16. As seen in FIG. 1, the swing-link 10 swings around the main shaft axis.

The action of the cam 6 is equivalent to a part of the action of the crank pin. Through expansion work after combustion, the pistons are pushed to drive the cam in rotation, and in turn, the cam rotates by inertia to push the pistons to perform the compression or discharging stroke, but cannot drive the pistons to perform the intake stroke as a crank pin does, and also cannot perform the function of the intake of the piston as the inner cam of the above-mentioned double cam engine does.

The action of the roller pair subassembly is equivalent to a part of the action of the connecting rod in the crankshaft and connecting-rod mechanism. Upon operation, the pistons are pushed to produce a couple through the roller surface tightly nestling against the curved surface of the downward stroke section of the cam to rotate the main shaft. Similarly, the curved surface of the upward stroke section of the cam nestles tightly against the roller surface to make the piston perform the compression or exhaust stroke.

The function of the swing-link linking mechanism is to produce an up and down linked motion of the two pistons and to prevent the roller from moving away from curved surface of the cam, and the air intake will be performed thereby too.

Figure 2:
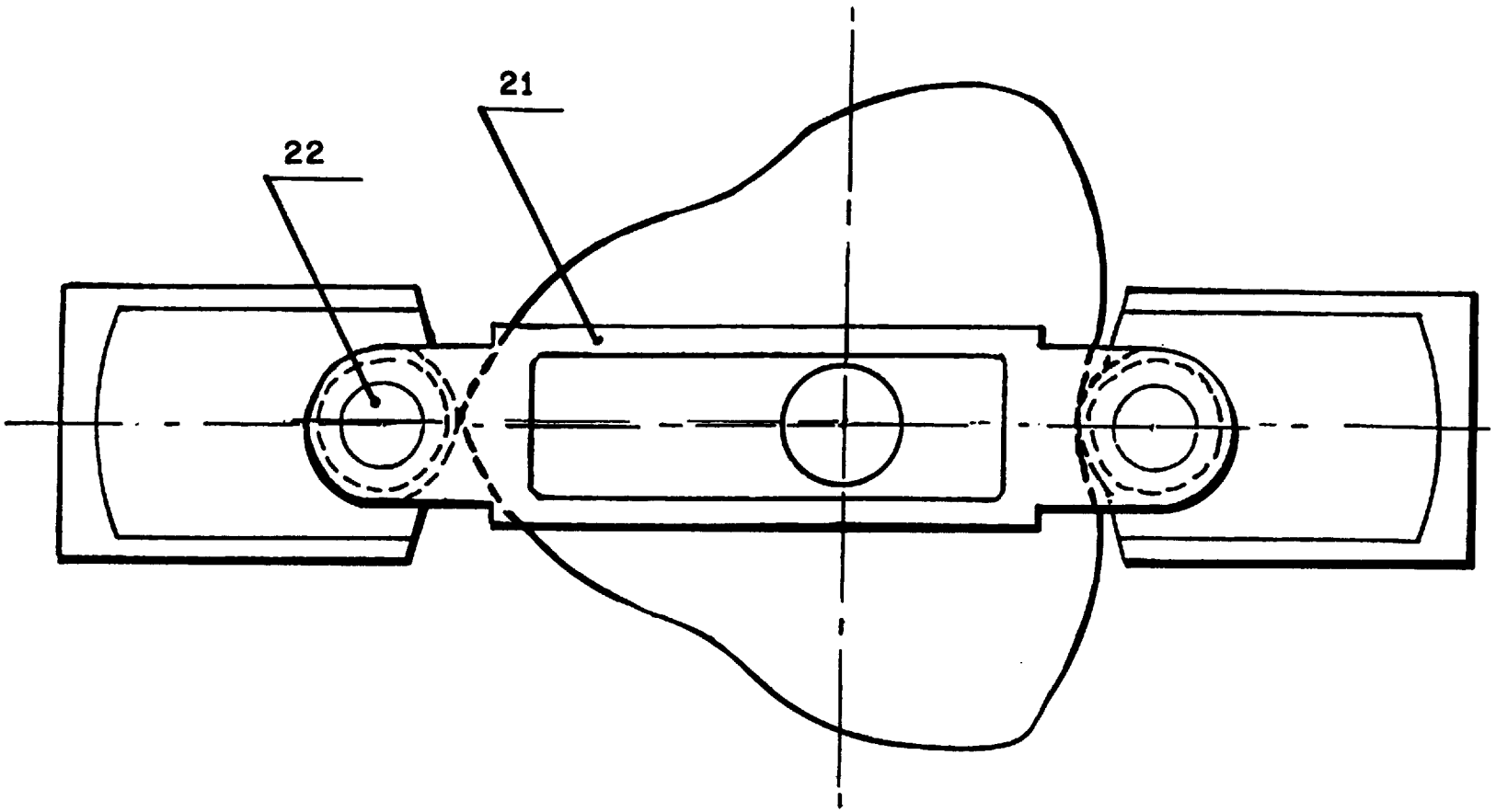
FIG. 2 is a schematic diagram of an engine, in which the cylinders are arranged at 180° intervals and employing a trisection cam and a frame-type linking-rod.
Figure 6:
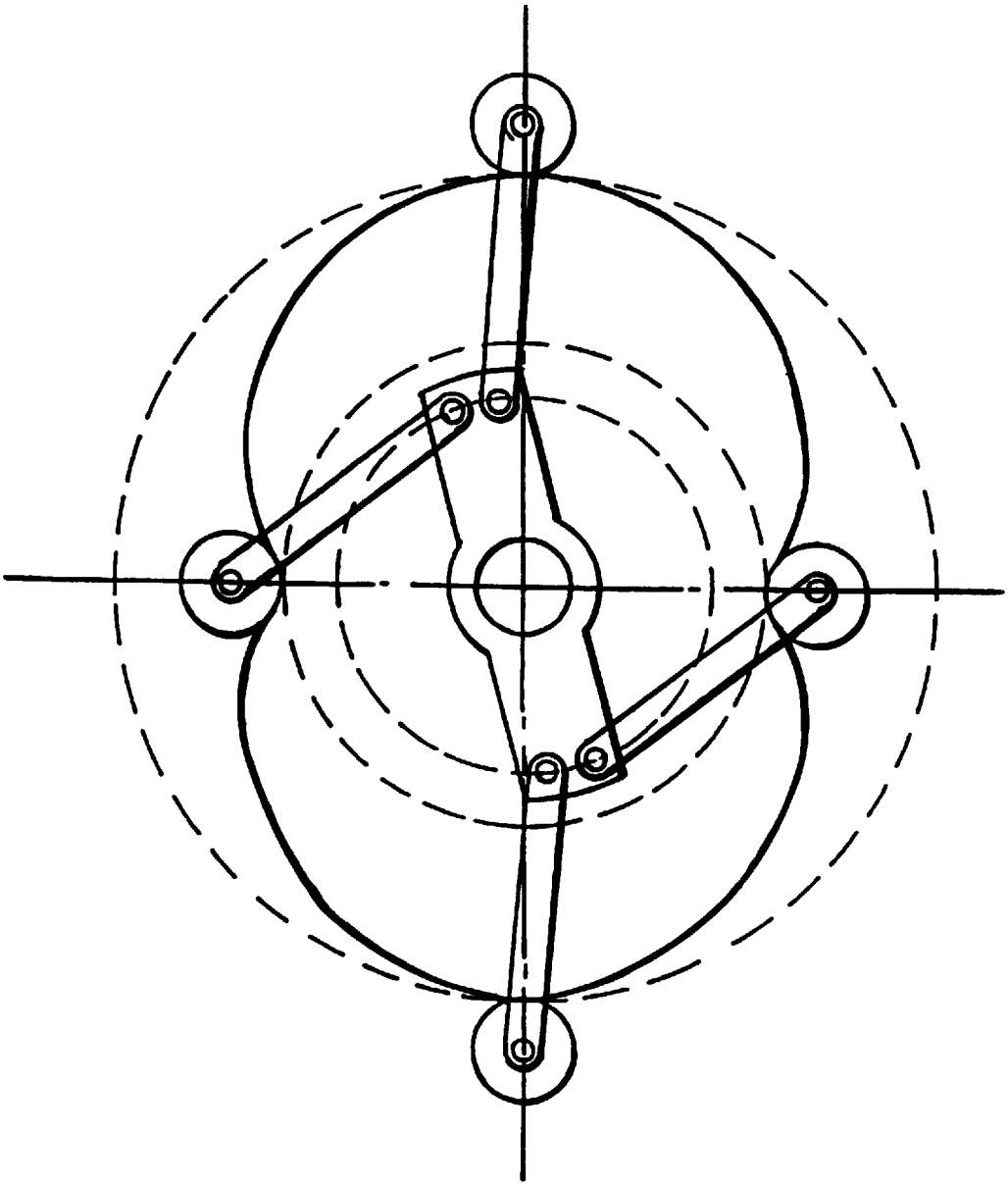
FIG. 6 is a schematic diagram showing a bisection cam, four pistons, and a swing-link linking mechanism.
Figure 7:
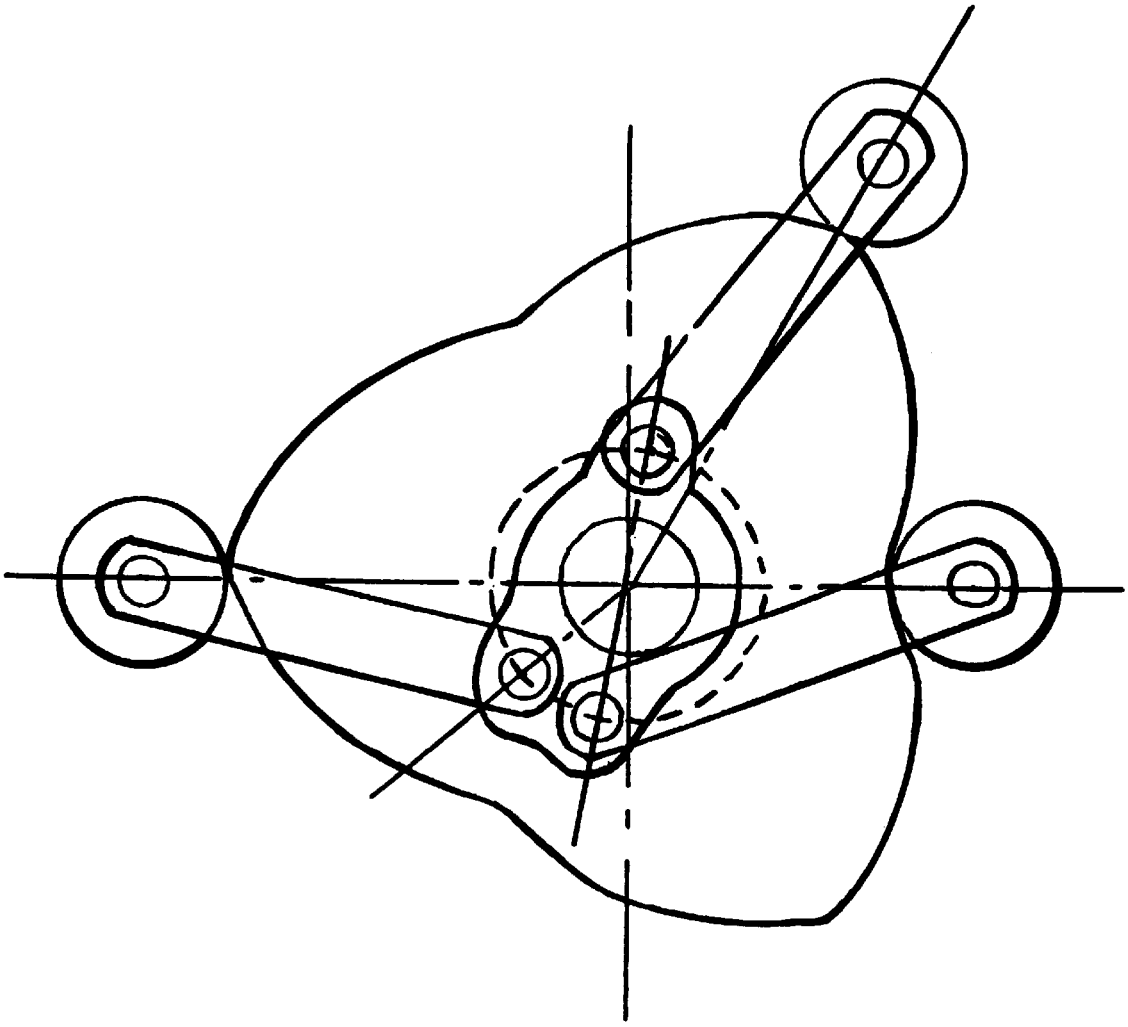
FIG. 7 is a schematic diagram showing a trisection cam, three cylinders, and a swing-link linking mechanism.

FIG. 2 shows a trisection cam and two pistons which are arranged 180° apart and move in the same direction along a centerline perpendicular to and intersecting with the cam axis, with one roller on one piston being tangent to the apex of the cam and the other roller being tangent to the lowest point thereof. Therefore, in this case, only a cam with equal sections and an odd number of lobes can meet this demand. The frame type linking-rod 21 not only diverges from the main shaft but also joins the two pistons together. The distance between the two linking-rod pin holes is maintained when the two rollers are simultaneously tangent to the cam. An engine having four-cylinder structures can be made if an additional frame type linking-rod is arranged on the other side of the cam.

Figure 8:
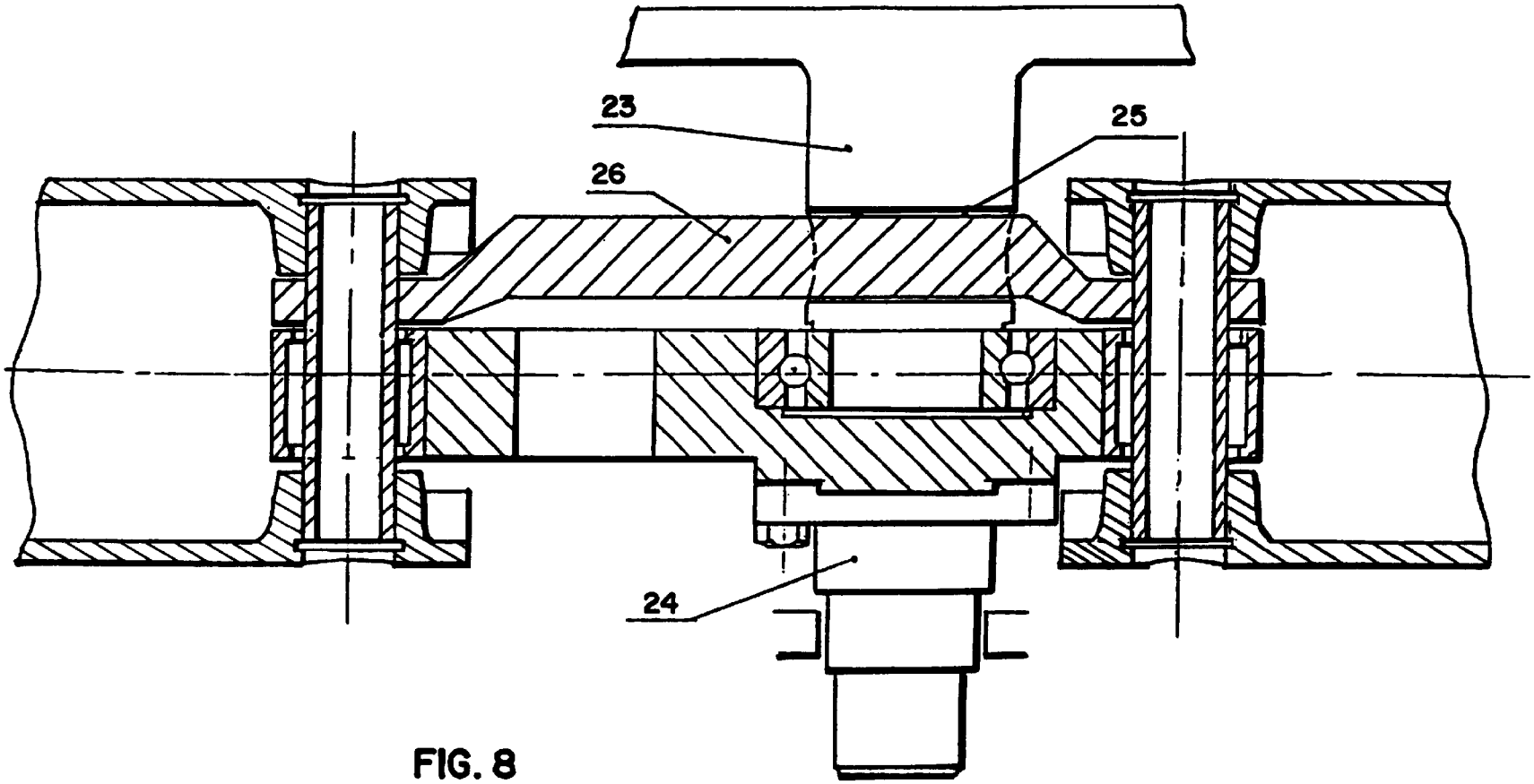
FIG. 8 is a schematic diagram showing a cylinder-type linking mechanism.
Figure 9:
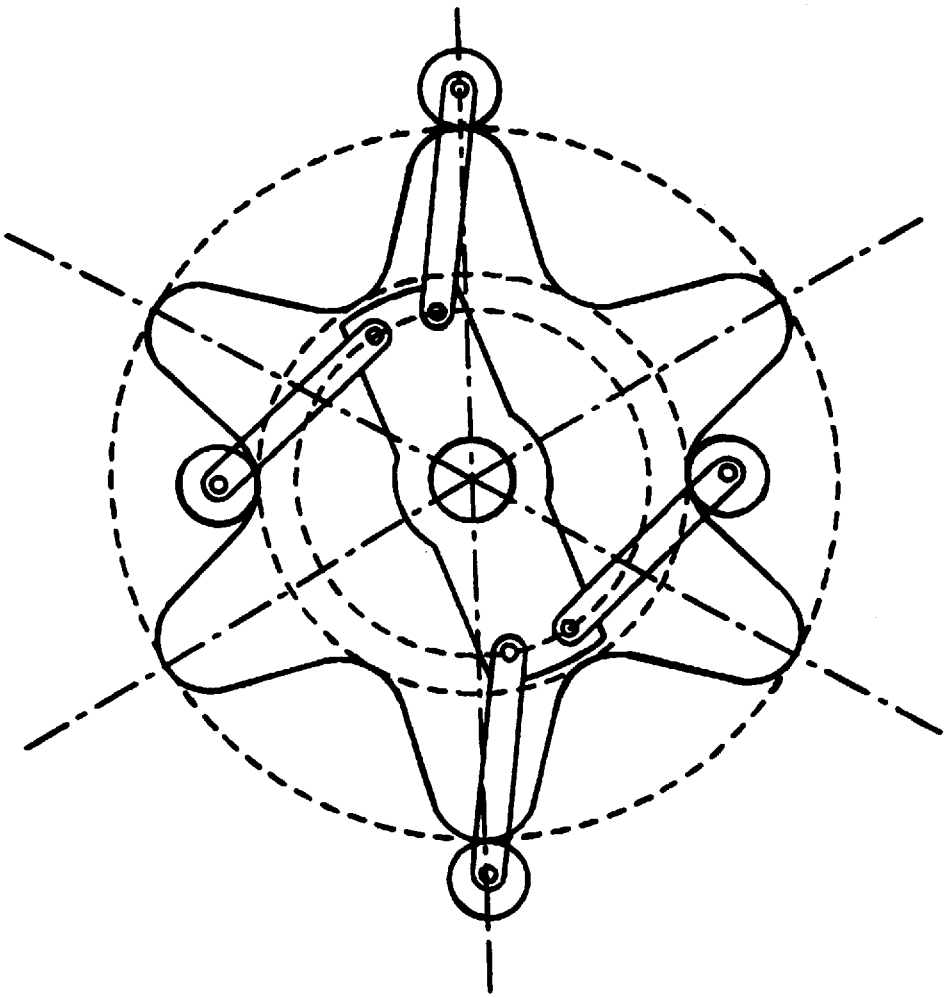
FIG. 9 is a schematic diagram showing a cam including six equal parts having six apexes and six nadirs.

In FIG. 8, a spindle nose is provided on an end cap 23, and the end of the spindle nose is connected to a bore of the cam by a bearing so as to position the cam and also enable it to rotate freely, and an output shaft 24 is joined to the cam by a flange connection. The spindle nose has a round hole 25 to match with a cylindrical type linking-rod 26. This structure has the advantage of good guiding action.

FIGS. 4 and 5 show a rectangular opening 21 on the lower part of the cylinder sleeve, through which the curved surface portion of the cam passes and which also has the advantage of good guiding action when the piston travels to reach its bottom dead center point.

Now with reference to the angular divisions shown in FIG. 1, an operation cycle of the engine and the working condition of its pistons and cam are described briefly as follows:

As illustrated, piston 1' is at the end of compression and piston 1" is at the end of intake, assuming the pistons are moving over the surface of the cam.

(1) The piston 1' moves toward the shaft 7 from 60° to 120° to perform the work stroke. The piston 1" moves outwards away from the shaft 7 from 0° to 60° under the driving of the cam to perform the compression stroke. At this moment, due to restraint of compressed air on the piston 1", the rollers will not move away from the curved surface of the cam, and the swing-link linking mechanism operates in a passive way, to which no restraint action is needed. The cam has turned 60° counterclockwise.

(2) The piston 1" performs the work stroke from 60° to 120°. Under the driving of the cam, the piston 1' performs the exhaust stroke from 120° to 180°. Within the work stroke, when the piston 1" is pushed to reach the bottom dead center position, the piston 1' will not separate from the cam surface at the top dead center position at the end of the exhaust stroke due to the restraint of the swing-link and connecting rod. The cam has turned another 60° counterclockwise.

(3) Under the action of inertia, the cam again turns 60° counterclockwise to push the roller to drive piston 1" and perform the exhaust stoke from 120° to 180°. The connecting-rod on piston 1" drives the swing-link to swing, and the connecting-rod on piston 1' moves the piston 1' towards the shaft from 180° to 240° to perform the intake stroke. Similarly, the piston 1' travels to reach the lowest point of the cam, and the piston 1" will not separate from the apex of the cam under the restraint of the swing-link and connecting-rod. During this process, the swing-link linking mechanism produces two actions, namely, "intake" and "restraint".

(4) Similarly under the action of inertia, the cam again turns 60° counterclockwise to push piston 1' outwards away from the shaft from 240° to 300° to perform the compression stroke. The swinging motion of the swing-link drives the piston 1" through the connecting rod to perform the intake stroke from 180° to 240°. During this process, the swing-link linking mechanism performs only the "intake" function.

Thus, the two pistons have each performed one operating cycle, as the cam has turned 240° counterclockwise.

The single cam swing-link reciprocating linked piston type engine of the present invention, in comparison with conventional reciprocating linked piston type engines, has advantages as follows:

1. The engine of the present invention features simple and rational structure, and convenience of machining and assembling. The reciprocating linked piston type engine, on the other hand, needs a sliding guide between the two linked pistons, so that machining and assembling are rather difficult.

2. The starting of the engine of the present invention is as convenient as one of the conventional crankshaft connecting-rod engines, and no auxiliary starting means, such as compressed air and spring, are needed, while such auxiliary starting means are needed in the reciprocating linked piston type engine.

3. The rollers of the engine of the present invention always nestle tightly against the curved surface of the cam, resulting in smooth operation and low loss of power; while the reciprocating linked piston type engine must adopt supercharged air intake in order to prevent the rollers from separating from the curved surface of the cam, and is therefore inapplicable for designing engines with lower capacity.

The present invention is further applicable for manufacturing internal combustion engines with various capacities.

We claim:

1. A single cam, reciprocating linked piston type engine, comprising:

at least one cam mounted on a main shaft defining a main shaft axis, said cam having a circumferentially continuous, curved outer surface including at least two apexes and at least two nadirs, said apexes being spaced from said nadirs so as to form a first included angle between each adjacent said apex and said nadir;

at least two pistons mounted for reciprocating movement within respective cylinders, each said cylinder defining a central axis that extends through said main shaft axis, and said cylinders being spaced apart so as to form a second included angle between the central axes thereof, said first included angle being equal to said second included angle, and each of said two pistons including a piston skirt at a lower end thereof and a roller pin hole and an opening formed in the piston skirt;

a swing link mounted at a middle point thereof on the main shaft for pivoting movement about a swing link axis coincident with the main shaft axis, said swing link including opposite ends and at least one swing link pin hole formed in each end, said swing link pin holes being symmetric about the swing link axis;

at least two connecting rods connecting the swing link to the two pistons, each said connecting rod having first and second ends with a connecting rod pin hole at each end, said connecting rods being connected at the first ends to the ends of the swing link by swing-link pins extending through the swing link pin holes; and at least two roller pair subassemblies connecting the second ends of the connecting rods to the pistons, each roller pair subassembly including a roller pin, a roller, and needles disposed between the roller pin and roller, the roller pin being fitted in the piston skirt opening of a respective one of the piston skirts and extending through the connecting rod pin hole at the second end of the connecting rod and the roller pin hole in the respective piston, and the roller being fitted in the respective piston skirt opening and engaged against the outer surface of the cam so as to be tangent therewith.

2. A single cam, reciprocating linked piston type engine according to claim 1, wherein said swing link include an additional said swing link pin hole formed in each end thereof, and further including third and fourth said pistons, and third and fourth said connecting rods connecting the swing link to said third and fourth pistons; and further wherein said circumferentially continuous, curved outer surface includes two said apexes and two said nadirs, and the axes of adjacent said cylinders are perpendicular to each other.

3. A single cam, reciprocating linked piston type engine according to claim 1, wherein said swing link includes an additional said swing link pin hole formed in one of the ends thereof, and further including a third said piston, and a third said connecting rod connecting the swing link to said third piston.

4. A single cam, reciprocating linked piston type engine according to claim 1, further comprising a second cam mounted on the main shaft in an offset position relative to the at least one cam.

5. A single cam, reciprocating linked piston type engine according to claim 1, wherein said swing link include an additional said swing link pin hole formed in each end thereof, and further including third and fourth said pistons, and third and fourth said connecting rods connecting the swing link to said third and fourth pistons; and further wherein said circumferentially continuous, curved outer surface includes six said apexes and six said nadirs, and the axes of adjacent said cylinders are perpendicular to each other.

6. A single cam, reciprocating linked piston type engine, comprising:

a cam mounted on a main shaft defining a main shaft axis, said cam having a circumferentially continuous, curved outer surface including at least two apexes and at least two nadirs, said apexes being spaced from said nadirs so as to form a first included angle between each adjacent said apex and said nadir;

two pistons mounted for reciprocating movement within respective cylinders, each said cylinder defining a central axis that extends through said main shaft axis, and said cylinders being spaced apart so as to form a second included angle between the central axes thereof, said first included angle being equal to said second included angle;

a swing link mounted at a middle point thereof on the main shaft for pivoting movement about a swing link axis coincident with the main shaft axis, said swing link including opposite ends; and two connecting rods connecting the swing link to the two pistons, each said connecting rod having first and second ends, said first ends being connected to the ends of the swing link and the second ends being connected to the pistons.

* * * * *